US006554159B1

(12) United States Patent
Behr et al.

(10) Patent No.: US 6,554,159 B1
(45) Date of Patent: Apr. 29, 2003

(54) DISPENSING DEVICE FOR MULTI-PACK CANS

(75) Inventors: R. Douglas Behr, Midland, MI (US); Mary Lou Hughes, Saginaw, MI (US)

(73) Assignee: Midland Technology Development Corporation, Midland, MI (US)

( * ) Notice: Subject to any disclaimer, the term of this patent is extended or adjusted under 35 U.S.C. 154(b) by 42 days.

(21) Appl. No.: 09/873,632

(22) Filed: Jun. 4, 2001

Related U.S. Application Data

(60) Provisional application No. 60/257,779, filed on Dec. 22, 2000, provisional application No. 60/263,975, filed on Jan. 24, 2001, and provisional application No. 60/265,038, filed on Jan. 31, 2001.

(51) Int. Cl.[7] ..... A47F 1/04

(52) U.S. Cl. ..... 221/305; 221/303; 229/122.1; 229/19; 312/45; 206/427; 206/429

(58) Field of Search ..... 312/45; 211/49.1, 211/59.2; 229/122, 122.1, 19; 221/312 R, 312 C, 303, 305, 191, 194; 206/427, 429, 435, 767, 774

(56) References Cited

U.S. PATENT DOCUMENTS

| | | | | | |
|---|---|---|---|---|---|
| 2,067,749 | A | * | 1/1937 | Zimmerman et al. | 221/305 |
| 3,522,878 | A | * | 8/1970 | Rosenburg | 221/312 R |
| 4,530,548 | A | * | 7/1985 | Spamer et al. | 211/59.2 |
| 4,805,765 | A | * | 2/1989 | Barrett et al. | 229/122 |
| 5,284,292 | A | * | 2/1994 | Johnson | 206/429 |
| 5,289,943 | A | | 3/1994 | Powell | 221/67 |
| 5,390,821 | A | | 2/1995 | Markel | 221/194 |
| 5,411,146 | A | * | 5/1995 | Jarecki et al. | 211/59.2 |
| 5,482,185 | A | * | 1/1996 | McNaughton | 206/427 |
| 5,584,431 | A | | 12/1996 | Clement | |
| 5,788,117 | A | | 8/1998 | Zimmanck | 221/285 |
| 5,878,947 | A | * | 3/1999 | Hoy et al. | 221/305 |
| 6,230,933 | B1 | * | 5/2001 | Wysoczynski | 206/427 |

OTHER PUBLICATIONS

Behr Et Al., U.S. Provisional No. 60/257,779 (Dec. 22, 2000).

Behr Et Al., U.S. Provisional No. 60/263,975 (Jan. 24, 2001).

Behr Et Al., U.S. Provisional No. 60/265,038 (Jan. 31, 2001).

Grayline Housewares, Grayline® Beverage Dispenser Tradedress, 1998.

Harriet Carter® Catalog Excerpt,F2997 Dispenser, Jan. 2001.

The Cookery Doc, Soda Caddy (™) Beverage Dispenser Trade Dress.

*The Detroit News*, Kitchen Guy: Soda Shoot Puts Pop In Easy Reach, Jul. 6, 1998 (http://detnews.com/1998/metro/).

* cited by examiner

*Primary Examiner*—H. Grant Skaggs

(57) ABSTRACT

Dispensing device can include a looped member having a plurality of stiff segments connected by hinges. For instance, the device can have five or six stiff segments connected by living hinges, at least three of which face outward and the other(s) inward in relation to the looped member. The device with six stiff segments can fold up so as to be placed inside a beverage container. As well, a dispensing device can have a member upon which a can or carton can rest and a reversible can-stop connected to it. The can-stop can be formed by a small, reversibly folding loop at one end of the member. In general, cylindrical objects exiting an opened carton can be restrained by providing a dispensing device having a generally flat base member and a can-stop; placing the base member under the objects in the carton with the can-stop outside the carton; and allowing at least one of the objects to roll from inside the carton to outside the carton where it is stopped by the can-stop. The device can go inside or under the carton.

24 Claims, 4 Drawing Sheets

DISPENSING DEVICE FOR MULTI-PACK CANS

CROSS-REFERENCE CLAIM OF DOMESTIC PRIORITY

This claims benefit under 35 USC 119(e) of U.S. provisional patent application Ser. No. 60/257,779 filed Dec. 22, 2000; Ser. No. 60/263,975 filed Jan. 24, 2001; and Ser. No. 60/265,038 filed Jan. 31, 2001. Each of the specifications of these applications of Behr et al., each in its entirety, is incorporated herein by reference.

BACKGROUND TO THE INVENTION

I. Field

The present invention concerns a device, useful in the dispensing of solid articles, for example, cylindrical cans.

II. Art with Problems

A twelve-, eighteen- or more-pack carton of beverages such as canned soda or beer is an esteemed comestible item, fit for quenching the thirst of a purchaser and his guests. Typically, however, although most such cartons are designed with flaps on each end of the carton, which can be torn away for dispensing the canned beverage, users stand the carton in a way in which a torn out orifice faces upwardly and reaches in to take a can, frequently tearing away the carton around the orifices as successive cans of beverage are sought and as they lie hidden lower and lower in the thus-positioned carton. One alternative is to use the carton as would be intended, with its torn out corner orifice at the bottom of the carton and facing the would be consumer, which itself is problematical as cylindrical cans of beverage often roll out the carton unabated. Another alternative is to place the carton on one side with the longitudinal axis of each can vertically oriented, but one disadvantage in doing so is that approximately fifty percent more shelf space is required, which is of particular concern if the shelf is in a refrigerator where space can be at a premium. Another disadvantage of the latter alternative is that cans are increasingly difficult to reach as the number of cans remaining in the carton is reduced.

In addressing this problem, various article dispensing apparatus have been proposed. Among such art may be mentioned the following U.S. patents:

U.S. Pat. No. 5,289,943 to Powell: HOLDER FOR DISPENSING CANS FROM MULTI-CAN CARTON.

U.S. Pat. No. 5,390,821 to Markel: METHOD AND APPARATUS FOR DISPENSING ROLLABLE ARTICLES.

U.S. Pat. No. 5,788,117 to Zimmanck: BEVERAGE CAN DISPENSER.

In addition, the following art is known:

Harriet Carter (Reg. U.S. Pat. & Tm. Off.) Catalog, January 2001, F2997 Dispenser. This is a two-level dispenser unit in which a top row of cans feeds into a bottom row of cans; the top row feeds rearward with bottom row feeding frontward; when a can is removed from the bottom row at a retrieval site at the front of that row, the lower row of cans move forward to fill up the front vacancy, with a can at the rear of the top row dropping down to the rear of the bottom row to fill up that rear vacancy.

Grayline (Reg. U.S. Pat. & Tm. Off.) Housewares 12-can wire beverage dispenser rack. This also is a two-level dispenser unit which is similar in operation to the Harriet Carter dispenser.

Soda-Caddy™ 12-can beverage plastic dispenser rack. This also is a two-level dispenser unit which is similar in operation to the Harriet Carter dispenser.

Soda-Shoot™ 12-can beverage plastic dispenser rack. This also is a two-level dispenser unit which is similar in operation to the Harriet Carter dispenser.

As effective as such art may be, it is not without drawbacks. Among these may be mentioned a certain inconvenience, bulkiness, and inefficiency in conversion of the apparatus to and from service and storage modes and/or in retaining or using the apparatus in such modes. In addition, known can dispenser devices such as the latter-mentioned two-level dispensers simply do not work well, if at all, in that the top row of cans often does not feed into the bottom row, and the bottom row of cans does not feed forward well with cans then becoming inaccessible.

It would be desirable to ameliorate if not overcome outright such drawbacks in the art.

SUMMARY OF THE INVENTION

The present invention provides a dispensing device comprising a looped member having a plurality of stiff segments connected by hinges. The device generally includes or can be manipulated to provide a can-stop. Beneficially, the dispensing device is made of a looped member having five or six stiff segments connected by so-called living hinges: in the former case, three or four of the hinges open (face) outward and one or two face inward in relation to the looped member; in the latter case, which may fold for insertion into a beverage carton, four or five hinges face outward with one or two facing inward. As an alternative to a large loop, the dispensing device can comprise a member upon which a can or carton can rest and a can-stop reversibly connected thereto; in this case, the can-stop may be a short loop. Also provided is a method to restrain cylindrical objects exiting an opened carton, comprising providing a dispensing device having a generally flat base member and a can-stop; placing the base member under the objects in the carton with the can-stop outside the carton; and allowing at least one of the objects to roll from inside the carton to outside the carton where it is stopped by the can-stop.

The invention is useful in assisting article dispensing.

Significantly, by the invention, inconvenience, bulkiness, and inefficiency in conversion to and from service and storage modes is ameliorated if not overcome outright. In particular, in an embodiment adapted for dispensing individual cylindrical cans of beverage from a carton such as a twelve-pack of soda or beer, the invention is most efficiently folded to its service mode and most easily folded flat to its storage mode. Advantageously, embodiments of the device may be made to fold up for insertion into a carton of beverages such as a twelve-pack or more. The invention can be made of lightweight, inexpensive materials, and can be pleasing to the eye as well as efficient in use.

Numerous further advantages attend the invention.

DRAWINGS

The drawings form part of the specification hereof. With respect to the drawings, which are not necessarily drawn to scale, the following is briefly noted:

DETAIL ILLUSTRATIVE OF THE INVENTION

Figure 1:
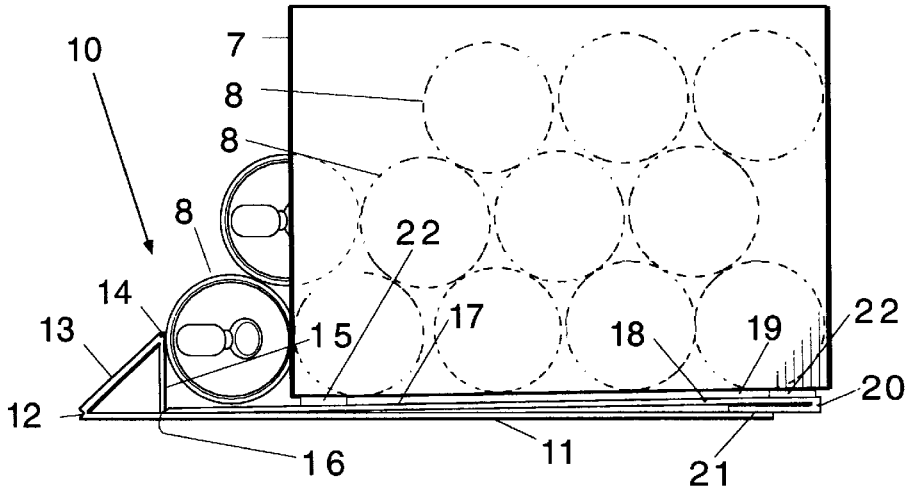
FIG. 1 is a side plan view of a dispensing device of the invention in use in its service mode dispensing canned beverages.

The invention can be further understood by the present detail, which may be read in view of the drawings. Such is to be taken in an illustrative and not necessarily limiting sense.

In general, the dispensing device of the invention can include a looped member with a plurality of stiff segments connected by hinges. The looped member can be any suitable material such as plastic, wood, metal, leather, cloth and so forth and the like, with one or more segments being stiff, and the hinges can be any suitable material such as plastic, metal, leather, cloth and so forth and the like. These may be connected in any suitable manner such as by gluing, melting, riveting, screwing, sewing, and so forth and the like. Advantageously, however, the looped member is a thermoplastic material to include a polyolefin, for example, a polyethylene, which is formed in one piece to make up the stiff segments connected integrally with "living hinges." Beneficially, the polyethylene is a high density polyethylene (HDPE). If not molded directly into a one-piece loop, a one-piece strip having the hinges can have the ends of the strip connected by any suitable means such as by gluing, melting, stapling, riveting, screwing, and so forth and the like to make the looped member. An overlap may provide a ramped feature to assist in the delivery of dispensed objects to the mouth or orifice of the carton. A high friction material may be placed between a lower segment and the surface upon which it may rest and/or between an upper segment and an outside panel of the carton or between a lower segment and an inside panel of the carton, for example, a strip of Skid Guard™ high friction material available from Sure Food Industries Corp., Cleveland, Ohio, which resembles sandpaper in general appearance on its top and is backed with an adhesive so that attachment is readily accomplished. Alternatively, one or both of these upper and lower segments may have an outwardly facing, high friction surface built in to assist in the dispensing operation. As a form of the latter, a roughened, slightly bumpy or matte pattern to the segment material itself may be provided as an outer, or top and bottom, surface to the dispensing device.

As a further alternative, in general, the device may be embodied as a member upon which a can or carton can rest, for instance, a stiff web, say, of wood, metal or plastic, or a flexible web, say, of cloth or plastic. At a strategic position along the member, say, about one end, a can-stop is reversibly connected thereto. For instance, the reversible can-stop may be a magnetically, releasable glue or static electricity attachable block, a block that is attachable by a hook and loop fastening system, or a short loop, say, that is attached to and/or integral or monolithic with the member, and made of stiff segments having hinges or living hinges between the segments and/or between a segment and the member upon which the cans such as in a carton, or carton containing cans, can rest. The short loop can be releasable such as by being connectable with magnetic or static electricity forces, releasable glue, clips, peg and hole features and/or other contrivances such as, for example, hook and loop type fasteners, and so forth and the like.

Figure 3:
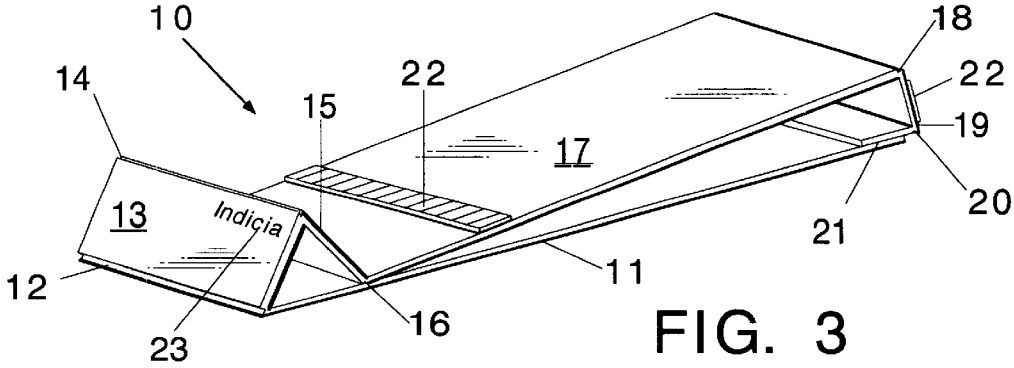
FIG. 3 is a top, side perspective view of the dispensing device found within FIG. 1 and depicted itself in FIG. 2 in a stage between its upraised service and flat storage modes.
Figure 4:
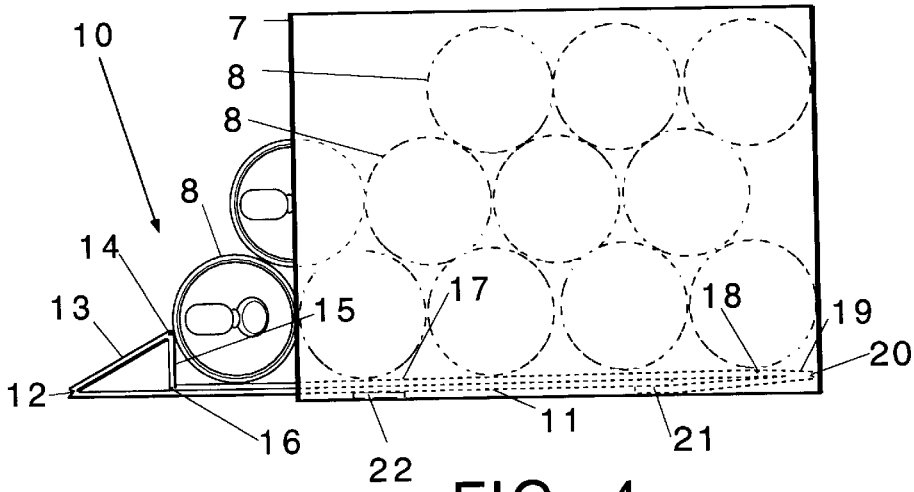
FIG. 4 is a side plan view of another embodiment of a dispensing device of the invention in use in its service mode dispensing canned beverages.

With respect to the drawings, dispensing device 10 is adapted for dispensing from an open end of carton 7 cylindrical articles 8, for example, cans of beverage from a conventional twelve pack (FIGS. 1 & 4). Beneficially, the device 10 can be a large looped member including connected parts and other features (FIGS. 1–3, 4–6, 11 & 12) such as follows:

| No. | Comment |
|---|---|
| 11 | Lower stiff segment. |
| 12 | First outwardly facing hinge. |
| 13 | Stop-reinforcing stiff segment. |
| 14 | Second outwardly facing hinge. |
| 15 | Article-stop stiff segment. |
| 16 | Inwardly facing hinge. |
| 17 | Upper stiff segment. |
| 18 | Third outwardly facing hinge. |
| 19 | Reversibly-facing stiff segment. |
| 20 | Fourth outwardly facing hinge. |
| 21 | Large loop overlap. |
| 22 | High friction material, say, about ½ to ¾ of an inch in length across all or a substantial part of the segment width. |
| 23 | Indicia. |

In embodiments which may fold up for insertion into a beverage carton (FIGS. 11 & 12), the segment 11 may include auxiliary segment 11A which is demarcated by hinge 11H. The hinge 11H preferably faces outward.

Figure 7:
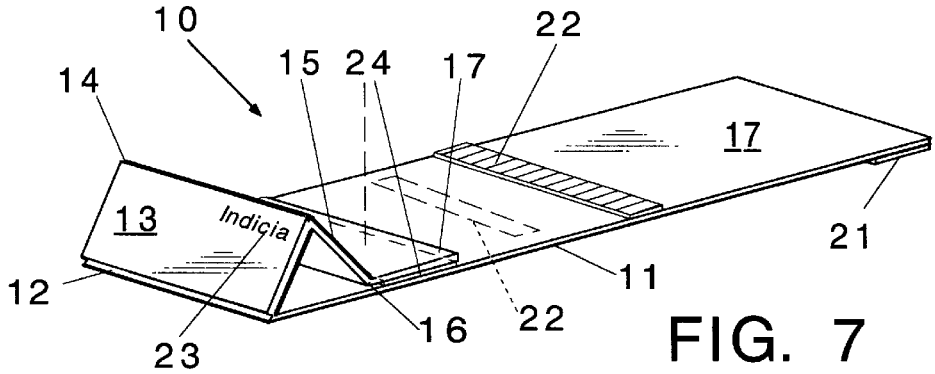
FIG. 7 is a perspective view of another embodiment of a dispensing device of the invention having a releasable can-stop, ready for use in its service mode.
Figure 8:
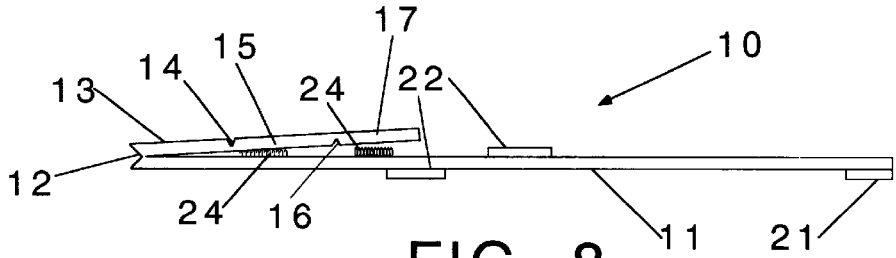
FIG. 8 is a side view of the dispensing device of FIG. 7, in a first storage mode, extended flat.
Figure 9:
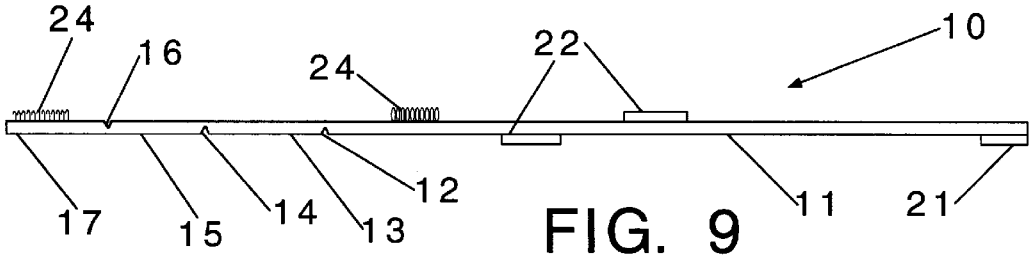
FIG. 9 is another side view of the device of FIG. 7, in a second storage mode, folded flat.

Alternatively, the device 10 can be a member upon which a can or carton can rest with a reversible can-stop connected thereto, and the can-stop may be a short, releasable loop, with connected parts and other features (FIGS. 7–9 and/or 10) such as follows:

| No. | Comment |
|---|---|
| 11 | Can underlying member or segment. |
| 12 | First outwardly facing hinge. |
| 13 | Stop-reinforcing stiff segment. |
| 14 | Second outwardly facing hinge. |
| 15 | Article-stop stiff segment. |
| 16 | Inwardly or outwardly facing hinge. |
| 17 | Can-stop securing segment. |
| 21 | Member buildup or wedge. |
| 22 | High friction material, say, about ½ to ¾ of an inch in length across all or a substantial part of the segment width. |
| 23 | Indicia. |
| 24 | Reversible can-stop forming fastening material, say, clips, or a hook and loop system material. |

In embodiments which may fold up for insertion into a beverage carton (FIGS. 13 & 14), the segment 11 may include auxiliary segment 11A which is demarcated by hinge 11H. The hinge 11H may face upward.

Another embodiment which may be used in a method to dispense cans simply has as the device 10 (FIG. 15) one such as follows:

| No. | Comment |
|---|---|
| 11 | Can underlying member or base. |
| 13/15 | Can-stop member. |

In such an embodiment, a simple L-shaped device is provided for insertion into (or placement under) the carton 7 so as to be an aid in the dispensing of the cans 8. As depicted, the device 10 of this embodiment has its base 11 permanently affixed to its can-stop member 13/15 and is useful in a method for dispensing cans from an open carton.

Figure 2:
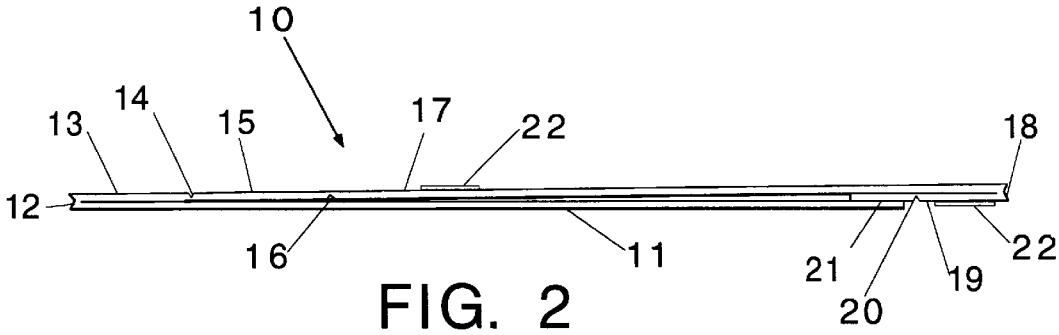
FIG. 2 is a side view of the dispensing device found within FIG. 1, in its storage mode, flat.
Figure 10:
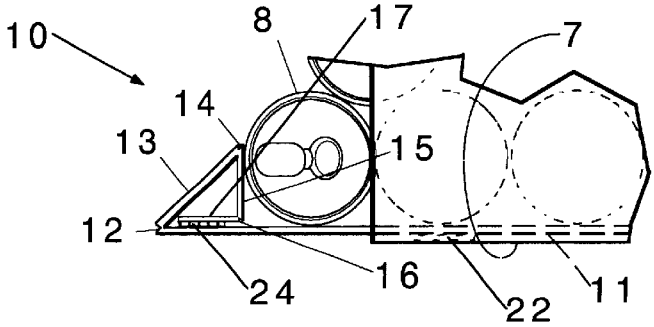
FIG. 10 is a side plan view of another embodiment of a dispensing device of the invention having a releasable can-stop, in use in its service mode dispensing canned beverages.
Figure 11:
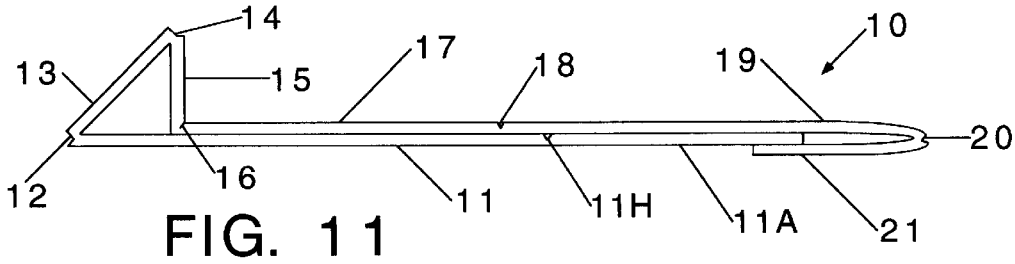
FIG. 11 is a side view of another embodiment of a dispensing device of the invention, shown in its dispensing configuration.
Figure 12:
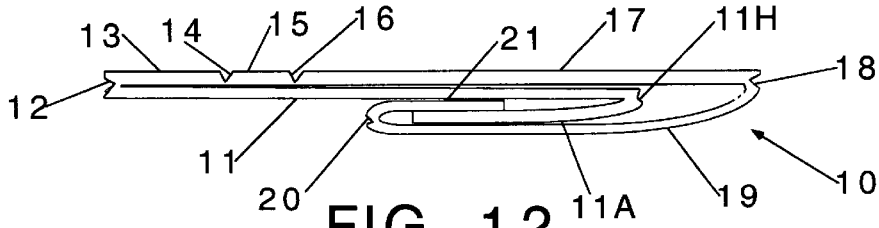
FIG. 12 is a side view of the device of FIG. 12, shown folded up so that it may be inserted into a beverage carton.

As mentioned previously, the invention is a device for dispensing articles, and is especially adaptable for dispensing cylindrical objects such as beverage cans directly from a multi-can carton. The device 10 has two general configurations, one of which is for service or dispensing (FIGS. 1, 4, 7, 10, 11 & 13): and another of which is for storage (FIGS. 2, 5, 8, 9, 12 & 14). Beneficially, the width of the device 10 may be approximately equal to the length of the cylindrical objects, referred to, for example, as cans, hence such a device 10 being able to be, say, about 4⅞ inches wide (FIGS. 1–3). The width may also be more or less than the length of the cans so long as, if it is less than the length of the dispensed can, it is of a sufficient dimension to adequately retain the can as its momentum is stopped by the stopping member set 13–15. Of course, the position of the device 10 with respect to the cans is taken into account, with centering therewith a desirable consideration. Thus, the device 10 is able to be, say, about 4½ inches wide (FIGS. 414 6) or 4⅜ inches wide (FIGS. 11 & 12). The length of the device 10 taken along an axis of the large looped (FIGS. 1–6, 11, 12) or flat (FIGS. 7–10, 13, 14) member can be approximately equal to the sum of the longest dimension of the carton 7 plus the diameter of a can 8 to be dispensed from the carton 7. The thickness of each segment 11, 13, 15, 17 or 19, exclusive of any overlap 21, can be any suitable dimension, for instance, about from 1/25 to 3/16 of an inch, say, about 1/16 of an inch. Again, as depicted in FIGS. 1–6, the device 10 can be considered to be a large loop of material, in a simple embodiment such as made from a polymeric sheet, having one segment 19, connected to the rest of the loop with hinges 18, 20, at one end of the loop and two hinged segments 13, 15, connected with each other by hinge 14 and connected with the rest of the loop with hinges 12, 16. Again, the hinges 12, 14, 18 and 20 face outwardly with respect to the large loop, and the hinge 16 faces inwardly with respect to the large loop. As seen in FIGS. 11 & 12, looped device 10 is made to be foldable for insertion in a beverage container such as a twelve-pack, which device can be made from HDPE, and compared to the device 10 of FIGS. 1–6, it has in the segment 11 an additional hinge 11H opening inwardly which demarcates auxiliary segment 11A; plus it has its hinge 18 moved further toward the stopping member set 13–15 than is the hinge 11H; its hinge 16 faces outwardly; it has a slightly bumpy outer surface.

Figure 13:
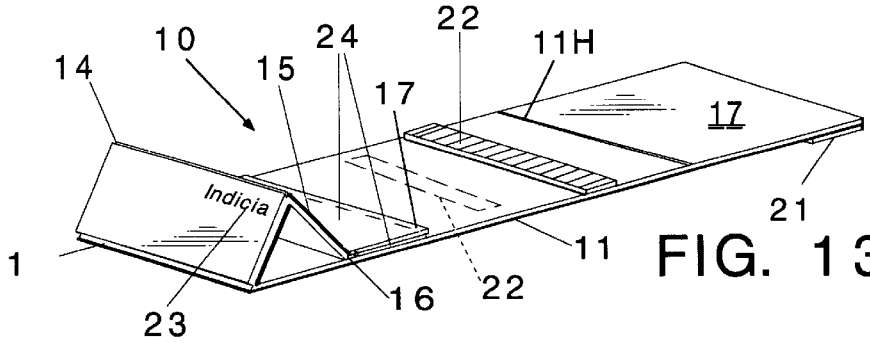
FIG. 13 is a perspective view of another embodiment of a dispensing device of the invention having a releasable can-stop, ready for use in its service mode.
Figure 14:
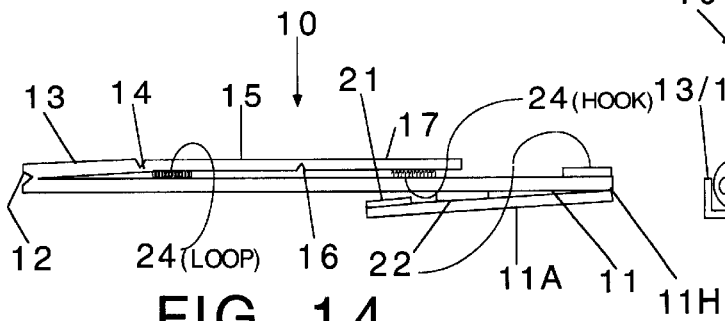
FIG. 14 is a side view of the device of FIG. 13, folded up so that it may be inserted into a beverage carton.

As depicted in FIGS. 7–9 & 10 and 13 & 14, the device 10 can be considered to be a substantially flat or ramped member 11 at one end of which a small, releasable loop with two hinged segments 13, 15, connected with each other by hinge 14 and connected with a can-stop securing segment 17 through hinge 16. The small loop is formed and a can-stop is provided through employment of reversible can-stop forming fastening material 24, for example, a hook and loop system material such as of Velcro (Reg. U.S. Pat. & Tm. Off) materials. Other can-stop fastening contrivances may be employed such as magnets, clips, simple widthwise grooves in the top surface of the member 11 into which a stiff segment 15 can be inserted without there being a securing segment 17 attached in the case of a small loop configuration, and so forth and the like. As seen in FIGS. 13 & 14, the device 10 can be folded up even further through provision of the hinge 11H in the segment 11, which can demarcate auxiliary segment 11A.

The configuration can be easily and quickly changed from its storage mode (FIGS. 2, 5, 8, 9, 12, 14) to its dispensing or service mode (FIGS. 1, 4, .7, 10, 11, 13). In the large looped embodiments (FIGS. 1–6) such change is by movement through an intermediate stage (FIGS. 3 & 6) by rotating reversibly-facing, hinged segment 19 to face from a downward position (FIGS. 2 & 5) to an upward position (FIGS. 1 & 4) and vice versa, in which case, doing so causes the upper stiff segment 17 to slide over the lower stiff segment 11, which, in turn, causes the two hinged segments 13, 15 to cooperatively form a lip or ridge for stopping a rolling can 8. In the additionally folding, looped device 10 (FIGS. 11 & 12) these same movements generally apply after the device 10 has its inside-the-carton fold, provided from folding the hinges 11H & 18, released. In the small looped embodiments (FIGS. 7–9 & 10) such change is by appropriately folding the segments 13, 15 to form the small loop, and attaching it to the member 11 through the segment 17 with the fastening material 24, and vice versa to go from service to storage mode. The embodiment of FIGS. 7–9 differs from the embodiment of FIG. 10 in that, in the former, the small loop is formed by fastening the segment 17 outside the small loop, whereas, in the latter, the small loop is formed by fastening the segment inside the small loop; accordingly, the hinge 16 in the former can open opposite the hinges 12, 14, but the hinge 16 in the latter can open in the same orientation as the hinges 12, 14, with the fastening material 24 appropriately positioned as may be required. In the additionally folding, small looped device 10 (FIGS. 13 & 14) these same movements generally apply after the device 10 has its inside-the-carton fold, provided from folding the hinge llH, released. In any case (FIGS. 1–14), the lip is readily visible, particularly the stop-reinforcing segment 13, when in its service configuration, and, therefore, suitable for displaying indicia 23, which may be provided on the outer surface of the segment 13, such as a business logo or other mark or identity or advertising therefor, to include, in addition to or in lieu of the maker or distributor of the device 10, a beverage or refrigerator manufacturer logo or other mark or identity or advertising therefor, or that of another unrelated concern, product or service such as an identity or logo of a city or state, or of a high school, college or professional sports team, or other information such as dietary information, meeting times for a fraternal or service club, business hours for a commercial concern, and so forth and the like.

Figure 15:
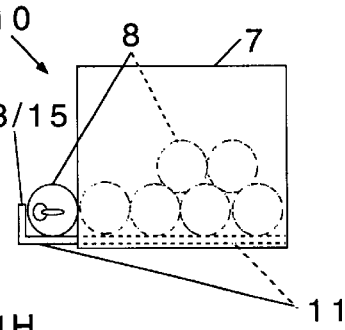
FIG. 15 is a side plan view of another embodiment in use in dispensing cans of beverage from another open carton in practice of the invention.

As depicted in FIG. 15, the device 10 may have the can-stop 13/15 permanently mounted to the base 11. Such a simple device 10 can find utility in a method of dispensing cans. Other configurations to the L-shaped device depicted in this figure are possible such as a wedge, for example, a triangular prism, permanently attached to a flexible or rigid base member made of cloth, wood, plastic, metal and so forth.

A permanently attached can-stop can be mounted to a looped member such as a large looped member. In such case, the can-stop is not formed from manipulation of the looped member. As an illustration of this, a solid, triangular prism may be glued along one of its faces to the looped member to provide the can-stop. Compare, FIGS. 1, 4, 7, 10, 11 & 13. However, the reversibly attachable can-stop embodiments depicted within the FIGS. 1–14 are preferred.

As shown in FIGS. 1–3, the carton 7 can be placed on the device 10 so that the long axes of the cans 8 are horizontally directed, i.e., normal to the long axis of the device 10. At least the surface of the device 10 in contact with the carton, i.e., segments 17, 19, may beneficially provided with material 22 having a high coefficient of friction, be it integrally provided to the loop or through an additional, separate material; this minimizes slipping of the carton 7 on the dispensing device 10. Desirably, the carton 7 is positioned so that the distance from the stopping segment 15 (lip part) is approximately equal to the diameter of one of the cans 8. The carton 7 may be opened either before of after it is placed on the device 10. Once the carton 7 is open and placed on the dispensing device 10, one can rolls forward against the lip part 15 owing to the force of gravity on the remaining cans (a ramp effect from the overlap 21 being able in general to assist in this) whereupon the lip part 15 restrains all the cans 8. When the can 8 resting against the lip part 15 is removed by lifting it up and forward, another can 8 moves against the lip part 15, and the remaining cans 8 in the carton 7 move generally down and forward. When only one row of cans 8 remains, the cans 8 tend to move towards the lip part 15 because the overlap 21 tilts the carton 7 slightly forward for the ramp effect; plus, as the carton 7 gets lighter from the withdrawal of cans 8, the device 10 may lift about its rear end features 18, 19, 20 which can help in rolling out the remaining cans 8, particularly in a remaining single row, out the carton 7 toward the front lip 13, 14, 15 to be stopped for consumer retrieval.

Figure 5:
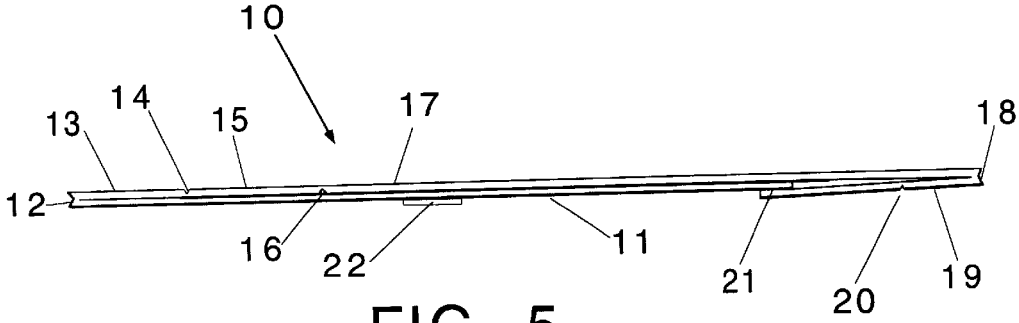
FIG. 5 is a side view of the dispensing device found within FIG. 4, in its storage mode, flat.
Figure 6:
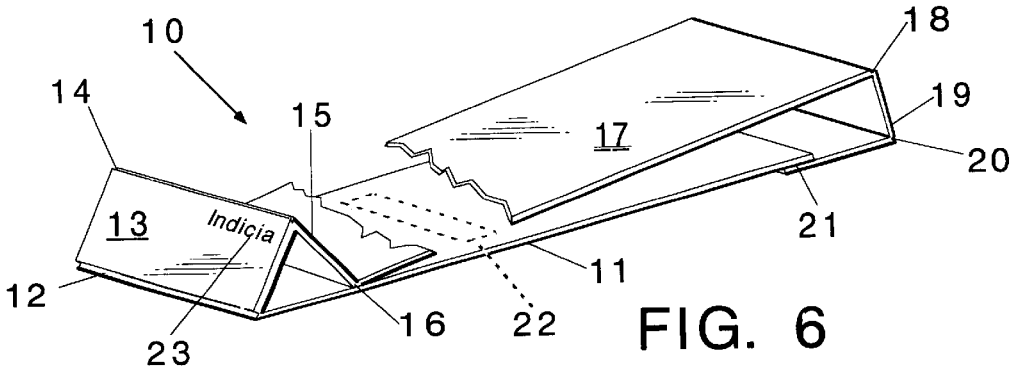
FIG. 6 is a top, side, partially cut away, perspective view of the dispensing device found within FIG. 4 and depicted itself in FIG. 5 in a stage between its upraised service and flat storage modes.

As shown in FIGS. 4–6, the device 10 can be placed inside the carton 7 in its service mode. In this configuration, the device 10 in contact with the inside panel of the carton 7, i.e., segment 21, may beneficially be provided with the material 22 having a high coefficient of friction so as to minimize slipping of the dispensing device 10 inside the carton 7. Otherwise, the device 10 inside the carton 7 (FIGS. 4–6) operates similar to the device 10 outside the carton 7 (FIGS. 1–3). However, the inside the carton device has the advantage of providing for a more secure arrangement for the combination (FIG. 4).

As shown in FIG. 15, the device 10 can go inside the carton 11. Nonetheless, it may be positioned under a carton.

In their service modes, the devices 10 shown in FIGS. 7–9 & 11–14 can be adapted to be placed outside or inside the carton 7. Compare, FIGS. 1 & 4. As well, the device within FIG. 10 is seen adapted for and placed in service inside the carton 7.

As mentioned previously, polyethylene, for example, HDPE, is a desired material for the device 10. Polypropylene, which is a polyolefin material known to be amenable to forming the so-called living hinges that can be flexed repeatedly without breaking, may be employed in the practice of the instant invention. However, polypropylene tends to be notch sensitive, and more so at lower temperatures. Advantageously, the living hinges can be made from a polyethylene sheet, especially integral with the segments. In general, polyethylene is affected less by reducing surrounding temperature such as found in a refrigerator or ice box.

It is good to configure the device 10 so that it has its lip part segment 15 vertical, or approximately so, with respect to the parallel lower and upper segments 11, 17 of the device 10 when in its service configuration. An acceptably advantageous alternative would be to have the lip part 15 provide for an acute (carton-facing) angle with respect to the segments 11, 17. This is because that, although somewhat useful, when the segment 15 provides for an obtuse angle with respect to the segment(s) 11 and/or 17, i.e., it faces away from the carton 7, such an arrangement allows for a rolling can to strike the segment 15 and sometimes roll over it. As well, the height of the lip part segment 15 when taken in connection with the service configuration of the device 10 can be equal to or greater than the radius of the can 8 for more effective stopping results (FIG. 1). However, this is not necessary, nor always desired, since a lower height of the lip part segment 15, say, about 1⅛ of an inch, can be satisfactory if not highly effective in stopping the cans 8 (FIG. 4) because the cans 8 usually do not have enough momentum generated in the system in which the carton 7 is positioned on a level surface. If the height of the segment 15, however, is greater than necessary, ease of removal of the can 8 is compromised.

Numerous additional benefits attend the invention.

CONCLUSION

The present invention is thus provided. Various features, parts, subcombinations and combinations can be employed with or without reference to other features, parts, subcombinations or combinations in the practice of the invention, and numerous and sundry adaptations and modifications can be effected within its spirit, the literal claim scope of which follows.

We claim:

1. A dispensing device comprising a looped member having a plurality of stiff segments connected by hinges, the device including or capable of being manipulated to provide a can-stop, wherein the device has a first end or the looped member about which the can-stop resides, and, away from the first end of the looped member, a second end of the looped member about which a cylindrical object can rest for rolling above or upon the device toward the first end of the looped member when the device is in a dispensing mode; the looped member has a single loop that spans from the first to the second ends of the looped member; and the device can dispense the cylindrical object from a multi-pack carton different from the device.

2. The device of claim 1, having five or six stiff segments connected by living hinges, at least three of which face outward and other(s) inward in relation to the looped member, wherein the can-stop is provided by manipulation of the looped member.

3. The device of claim 2, having a high friction outer surface on at least one segment to be in contact with a carton or surface upon which the device may rest.

4. The device of claim 2, which is made of a plastic material, and the hinges are living hinges.

5. The device of claim 4, with the plastic a polyolefin.

6. The device of claim 5, with the plastic a polyethylene.

7. The device of claim 1, which has six stiff segments and can fold up so as to be placed inside a beverage container.

8. The device of claim 7, having a roughened, slightly bumpy or matte outer surface.

9. The device of claim 7, which is made of a plastic material, and the hinges are living hinges.

10. The device of claim 9, with the plastic a polyolefin.

11. The device of claim 10, with the plastic a polyethylene.

12. The device of claim 1, having indicia thereon.

13. The device of claim 1, which is made of a plastic material, and the hinges are living hinges, and wherein the can-stop is provided by manipulation of the looped member.

14. The device of claim 1, wherein the can-stop is a permanently attached can-stop, and extends from and is permanently mounted to the looped member.

15. The device of claim 1, further comprising, in combination, the multi-pack carton different from the device.

16. A dispensing device comprising a member upon which a first can or carton different from the device can rest and only one reversible can-stop connected thereto, wherein the device has a first end about which the can-stop resides, and, away from said first end, a second end upon which the first can, a second can, or carton can rest; the device can dispense the first and second cans resting upon the member or another can resident in the carton above the member; the member has an upper surface which is substantially straight from said first to said second ends; and the reversible can-stop a can when the device is in the dispensing mode and to fold substantially flat when the device is in a storage mode, and the can-stop is formed by a small loop having three segments thereto, which forms an inclined surface when in the dispensing mode.

17. The device of claim 16, wherein the small loop is provided by attachment with hook and loop material connections.

18. The device of claim 16, having indicia thereon.

19. A dispensing device comprising a generally flat base member having a length and a width, the length of the base member being greater than the width, and the width approximately equal to a length of a cylindrical object to be dispensed, and a can-stop, wherein the base member has a first end about which the can-stop resides, and, away from said first end, a second end upon which the cylindrical object can rest for rolling above or upon the device toward the first end of the base member when the device in in a dispensing mode; the device can dispense the cylindrical object from a multi-pack carton different from the device; and the device includes stiff members that can be rotated about interconnecting hinged joints to form, in the dispensing mode of the device, the can-stop, which in the dispensing mode of the device has a triangular loop shape with an inclined surface to the base member, and that can be rotated back reversibly to form a substantially flat storage mode of the device.

20. The device of claim 19, wherein the base member has an additional hinge between the first and second ends.

21. In combination, a dispensing device different from a multi-pack carton, with the device having a base member with a substantially flat upper surface at least when the device is in a dispensing mode, and a reversible can-stop which can stop a can when the device is in the dispensing mode and to fold substantially flat when the device is in a storage mode, and an at least three-segment loop that can reversibly form at least one of the base member and the can-stop; and the carton which is different from the dispensing device and is capable of containing cylindrical beverage containers, in or under which carton the dispensing device can rest with its can-stop external the carton, wherein the device has a hinge in the base member intermediate opposing first and second ends of the base member; about the first end, the can-stop resides, and, away from the first end, the second end is present, about which a can can rest for rolling above or upon the device toward the first end of the base member when the device is in the dispensing mode; and said hinge is useful for folding the device essentially in half in a folded storage mode.

22. In combination, a dispensing device different from a multi-pack carton, with the device having a base member with a substantially flat upper surface at least when the device is in a dispensing mode, and a reversible can-stop which can stop a can when the device is in the dispensing mode and to fold substantially flat when the device is in a storage mode, and an at least three-segment loop that can reversibly form at least one of the base member and the can-stop, wherein the can-stop forms an inclined surface with respect to the substantially flat upper surface when the device is in the dispensing mode; and the carton which is different from the dispensing device and is capable of containing cylindrical beverage containers, in or under which carton the dispensing device can rest with its can-stop external the carton.

23. The combination of claim 22, wherein the base member and the can-stop are made of a plastic material, with living hinges seperating adjacent segments of said loop.

24. The combination of claim 22, wherein the dispensing device can-stop is reversibly connected to the base member by formation of a small triangular loop at a first end of the base member, and the base member is formed of a substantially flat web with a second end above or upon which a can can rest and roll toward the can-stop.

* * * * *